United States Patent [19]

Bosler

[11] 3,992,724

[45] Nov. 23, 1976

[54] NOVELTY DEVICES

[75] Inventor: Robert W. Bosler, Levittown, Pa.

[73] Assignee: Design Interface, Inc., Princeton, N.J.

[22] Filed: May 14, 1975

[21] Appl. No.: 577,396

[52] U.S. Cl. ..... 2/173; 2/1; 46/154

[51] Int. Cl.[2] ..... A42B 1/18

[58] Field of Search ..... 2/9, 173, 1, 200, 201, 2/209.1, 202, 203, 205, 171, 175, 185 R; 46/154

[56] References Cited

UNITED STATES PATENTS

| | | | |
|---|---|---|---|
| 2,680,935 | 6/1954 | Smart | 46/124 |
| 3,183,622 | 5/1965 | Frankl | 46/154 |

*Primary Examiner*—G. V. Larkin

*Attorney, Agent, or Firm*—Finnegan, Henderson, Farabow & Garrett

[57] ABSTRACT

A folded structure having utility as the base structure for fanciful novelty structures. The structure is comprised of a base sheet and four outer sheets. The base sheet has eight alternate convex and concave folds. The four convex folds pass through the center of the base sheet and the midpoint of the four sides of the base sheet. Four concave folds pass through the center of the base sheet and through each of the four corners. Four smaller outer sheets are connected to the outer edge of the base sheet. The outer sheets are bisected by convex folds extending outwards from the four respective corners of the base sheet. The resulting structure is a hingeable, flexible, easily-opened structure that can be folded flat making it a useful base for novelty structures.

20 Claims, 13 Drawing Figures

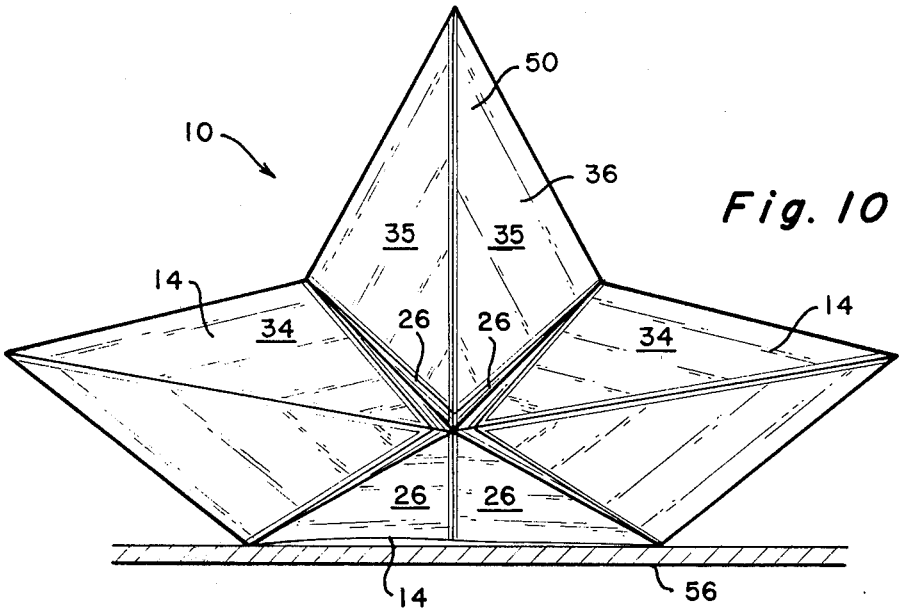
Fig. 10
Fig. 13
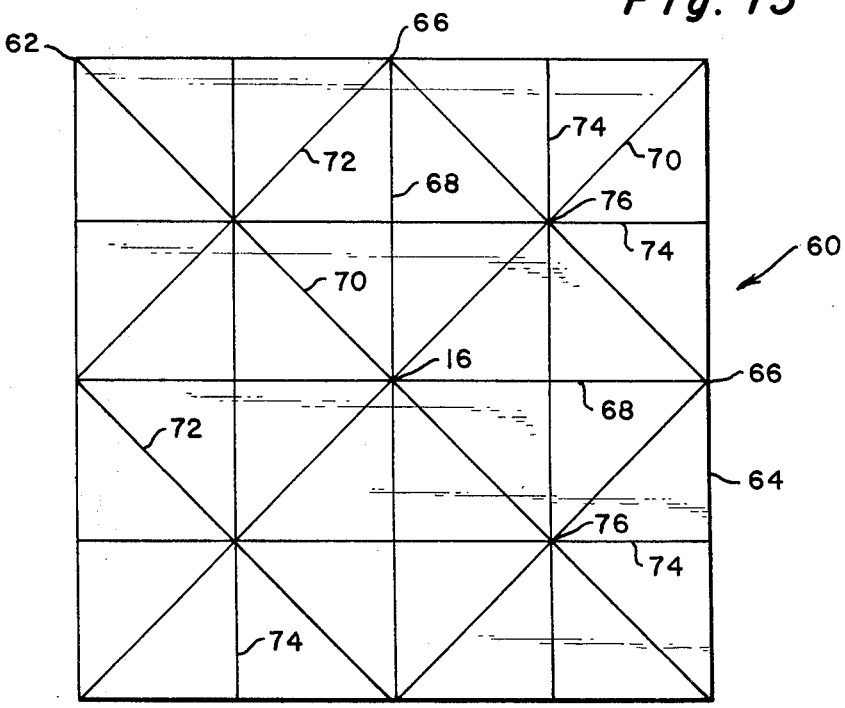

NOVELTY DEVICES

BACKGROUND OF THE INVENTION

The present invention relates to novelty items and in particular such items as pupppets and masks forming three-dimensional caricatures of animals, birds, etc.

It is particularly desirable to form three-dimensional caricatures of animals, birds, etc. for use as novelty items such as masks, greeting cards or hand puppets. Such items can be formed of paper or plastic and sold at relatively low prices.

It is particularly desirable that such items be easily constructed, shipped and stored to maintain the price at a low level. In order to achieve this desirable result and yet present a three-dimensional caricature, the item must be capable of being easily manipulated from a flat form to a three-dimensional shape. For storage after use, it is desirable that the item be collapsible again to a flat form, but also again be easily manipulated to a three-dimensional shape.

This prior art has sought to provide such novelty items. Typical of a first method of forming such structures in U.S. Pat. No. 3,183,622 where a complex blank is folded to form a novelty device. The necessity of forming the structure from a relatively complex blank requires complicated equipment and machinery to form the blank and the process of forming such blanks generates waste. The invention as herein described in preferably constructed from a single square sheet the formation of which does not require complex equipment nor does the formation generate significant amounts of waste.

A prior art teaching of a folded novelty device generated from a single square sheet is found in U.S. Pat. No. 502,896. While this reference teaches a structure similar to that of the invention disclosed herein, there are several differences between the structures that make the prior art markedly inferior in function to the present invention. The absence of diagonal folds in the outer sheets shown as *a* in FIG. 5 of the cited patent prevents the device from being folded flat in the manner of the present invention. Furthermore, the cited patent does not disclose the use of character defining, stiffening members affixed to the folded sheet in such a manner as to provide an integral structure that can be used as a puppet or the like. Nor does it disclose the use of the folded sheet as a part of a mask.

When the present invention is constructed in the puppet embodiment, with projections from the basic structure, the puppet can only be folded flat while maintaining the appearance of the puppet with the addition of the fold lines not taught or suggested in the prior art. The manner of folding a puppet embodiment allows essentially flat packaging of such a puppet with no need to reform the puppet structure to see the appearance of the character depicted by the puppet.

Furthermore, if the projections of the puppet embodiment of the invention were placed on the prior art structure in an analogous position the folding of the prior art structure to the smallest flat structure would yield a flat structure significantly larger than the flat folded structure of the present invention.

It is the object of the present invention to alleviate the difficulites of the prior art by providing a base structure for a folded novelty device that can be formed from a simple blank.

It is a further object of the invention to provide a base for a puppet structure that can be folded flat while maintaining the appearance of the character depicted by the puppet.

An additional object of the invention is to provide a base for a puppet that can be folded flat and displayed in a package or container of minimum size.

A further object of the invention is to provide a flexible spacial separation for components of a mask that can be collapsed to a relatively flat configuration while maintaining the appearance of the character depicted by the mask.

It is also an object of the invention to provide a novelty item at a minimum cost by developing the item from a simple blank that can be preformed and folded without the need for complex machinery.

Finally, it is an object of this invention to provide three-dimensional novelty items, i.e., hand puppets, greeting cards and masks that may be packaged in a flat compact form; repeatedly opened to a three-dimensional shape and reformed to the original flat form with relative ease and without detracting from the quality of the novelty item.

Additional objects and advantages of the invention will be set forth in part in the description which follows, and in part will be obvious from the description or may be learned by practice of the invention. The objects and advantages of the invention may be realized and attained by means of the instrumentalities and combinations particularly pointed out in the appended claims.

SUMMARY OF THE INVENTION

The present invention is comprised of a substantially square base sheet having a center, four base edges and four base corners with eight base folds therein. Four of the folds are convex and pass from the midpoint of each of the base edges forming four minor squares. The minor squares are bounded by the convex base folds and the base edges. Four of the base folds are concave bisecting the minor squares from the center to the base corners forming eight base minor triangles. Four outer sheets are connected to each of the minor squares along the base edges. The outer sheets each have a concave outer sheet fold passing from the base corners bisecting the outer sheets forming eight outer sheet triangles. The outer sheets and the minor squares form four four-sided elements each comprised of two base minor triangles anad two outer sheet triangles.

A preferred embodiment of the invention would have one base minor triangle per element affixed to an adjacent base minor triangle to form a hingeable structure having utility as a base for a puppet structure, or as a greeting card.

Another preferred embodiment would have one element with both base minor triangles affixed to adjacent base minor triangles to form a hingeable spacial structure having utility as a component in a mask structure.

BRIEF DESCRIPTION OF THE DRAWINGS

The invention consists in the novel parts, constructions, arrangements, combinations and improvements shown and described. The accompanying drawings, which are incorporated in and constitute a part of this specifications, illustrate several embodiments of the invention and, together with the description, serve to explain the principles of the invention.

Of the Drawings:

FIG. 10 is a view of the structure of the invention disposed to be a component of a mask;

FIG. 13 is a view of a blank that is folded to yield one embodiment of the structure of the invention.

DETAILED DESCRIPTION OF THE INVENTION

Reference will now be made in detail to the preferred embodiments of the invention, examples of which are illustrated in the accompanying drawings.

Figure 5:
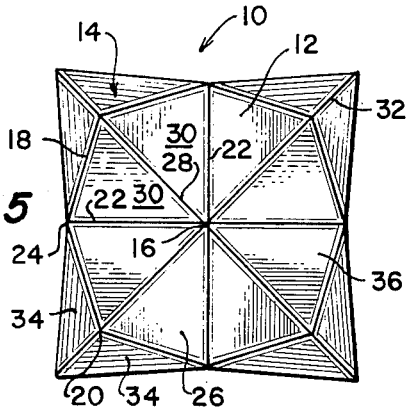
FIG. 5 is a view of the same side as FIG. 4 after the formation of the eight folds.

Referring to FIG. 5, the folded structure 10 embodying the concepts of this invention is generally comprised of a base sheet generally 12, with four outer sheets generally 14 connected thereto.

Figure 4:
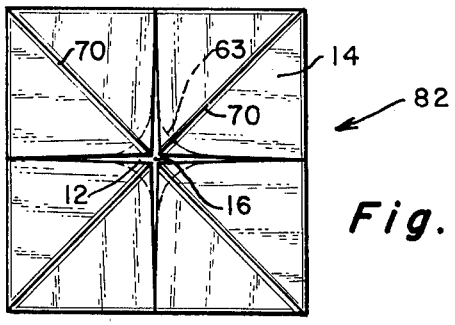
FIG. 4 is an enlarged view of the reverse side of the view of FIG. 3 showing the size of the square base sheet and the four outer sheets connected thereto.

In accordance with the invention, the base sheet 12 is substantially square and has a center 16, four base edges 18 and four base corners 20. The substantially square base sheet 12 has eight folds. Four of the eight folds are convex base folds 22 as shown in FIG. 5. The convex base folds 22 extend from the midpoint 24 of the four base edges 18 to center 16 forming four base minor squares 26. As shown in FIG. 5, the base minor squares 26 are somewhat distorted due to the perspective of the three dimensional structure 10; however, as shown in FIG. 4, the minor squares 26 are of the same general size, configuration and orientation as the outer sheets 14. The base minor squares 26 are bounded by the convex base folds 22 and the four base edges 18. Four of the folds in the base sheet 12 are concave base folds 28 bisecting the base minor squares 26 from the center 16 to the base corners 20 to form eight base minor triangles 30.

In a preferred embodiment, two pairs of adjacent base minor triangles 30 are joined together. In such an embodiment, the structure so formed provides an improved base for a novelty structure.

In accordance with the invention as embodied in FIG. 5, four outer sheets 14 are connected to the minor squares 26 on the base sheet 12 along the base edges 18.

Preferably, the outer sheets 14 are square and each approximately equal in area to one of the base minor squares 26. FIG. 4 shows this preferred embodiment of the outer sheets 14. It is also preferred that the base sheet 12 and the outer sheets 14 be integrally formed from a primary square sheet 60 of uniform thickness. The formation of this preferred embodiment of the invention is illustrated in FIGS. 1 through 4 and will be described in detail in a later section of this disclosure.

Another embodiment of the invention would have the base sheet 12 comprised of a different material than that of the outer sheets 14. Preferably, the base sheet 12 would have a thickness greater than that of the outer sheets 14.

In accordance with the invention, the four outer sheets 14 as depicted in FIG. 5 have concave sheet folds 32 passing from the base corners 20 bisecting the outer sheets 14 and forming eight outer sheet triangles 34. The outer sheets 14 and the base minor squares 26 form four four-sided elements generally 36.

Figure 6:
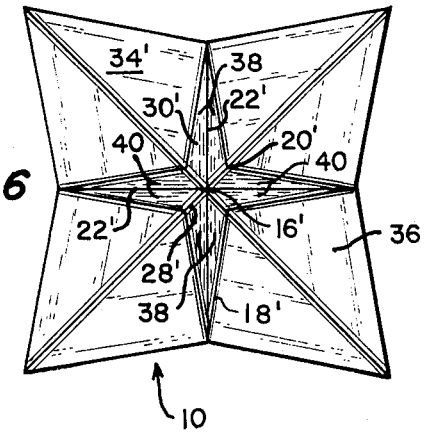
FIG. 6 is the reverse side of the structure of FIG. 5 showing the triangular contacting surfaces and the folds in the four outer sheets.

The reverse side of the structure of FIG. 5 is shown in FIG. 6. For purposes of illustration, the folds and surfaces shown in FIG. 5 by a number are shown in FIG. 6 by that same number primed. For example, the base convex folds 22 in FIG. 5 are base concave folds 22′ in FIG. 6. It should also be noted that FIG. 6 is not merely the reverse of FIG. 5 as both figures were constructed to clearly illustrate the structure 10. The corners 20′ of FIG. 6 would have to be moved away from each other expanding the structure 10 slightly in order that the reverse side of FIG. 6 would be identical to the embodiment of FIG. 5. As shown in FIG. 6, the folds 22′ are concave passing through the center 16′. Folds 28′ are convex and bisect the outer sheets 14′ forming the outer sheet triangles 34′. The base minor triangles 30′ are bounded by the concave folds 22′ and the convex folds 28′.

Figure 7:
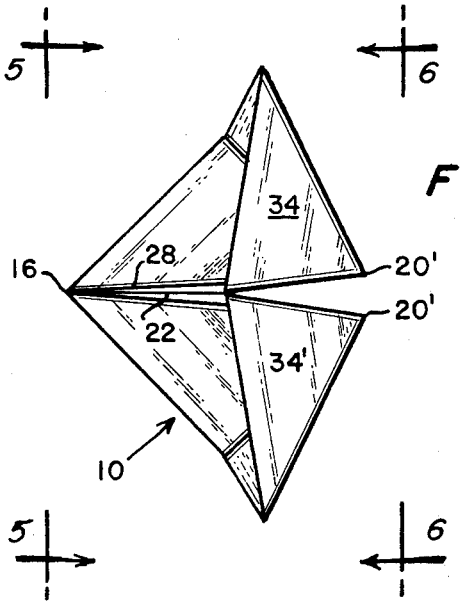
FIG. 7 is a side view of the structure of FIGS. 5 and 6.

FIG. 7 illustrates the embodiment of FIGS. 5 and 6 in side view showing the configuration of the outer sheet triangles 34′, the convex base folds 22, the center 16 and the concave base folds 28. In this configuration, the flexible nature of the structure is illustrated by the corners 20′ being separated.

A preferred embodiment having special utility as the base for a puppet structure has one base minor triangle 30 per element 36 joined to an adjacent base minor triangle 30′.

As illustrated in FIG. 6, two opposite pairs generally 38 of base minor triangles 30′ can be joined to provide this preferred embodiment. Similarly, two opposite pairs generally 40 of base minor triangles 30′ could be joined to provide a similar structure.

Figure 8:
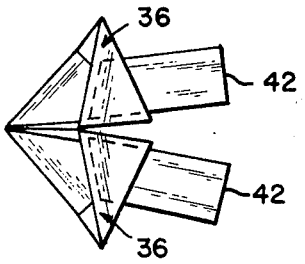
FIG. 8 is a side view of the structure of the invention where planar projections are affixed to opposing triangular contacting surfaces.

Preferably, a puppet embodiment includes, along with a plurality of joined base minor triangles 30, a planar projection affixed between at least one pair of the joined base minor triangles. As depicted in FIG. 8, two planar projections 42 are affixed to the structure with each projection positioned between opposite pairs 38 (FIG. 6) of joined base minor triangles 30 on the elements 36.

Figure 9:
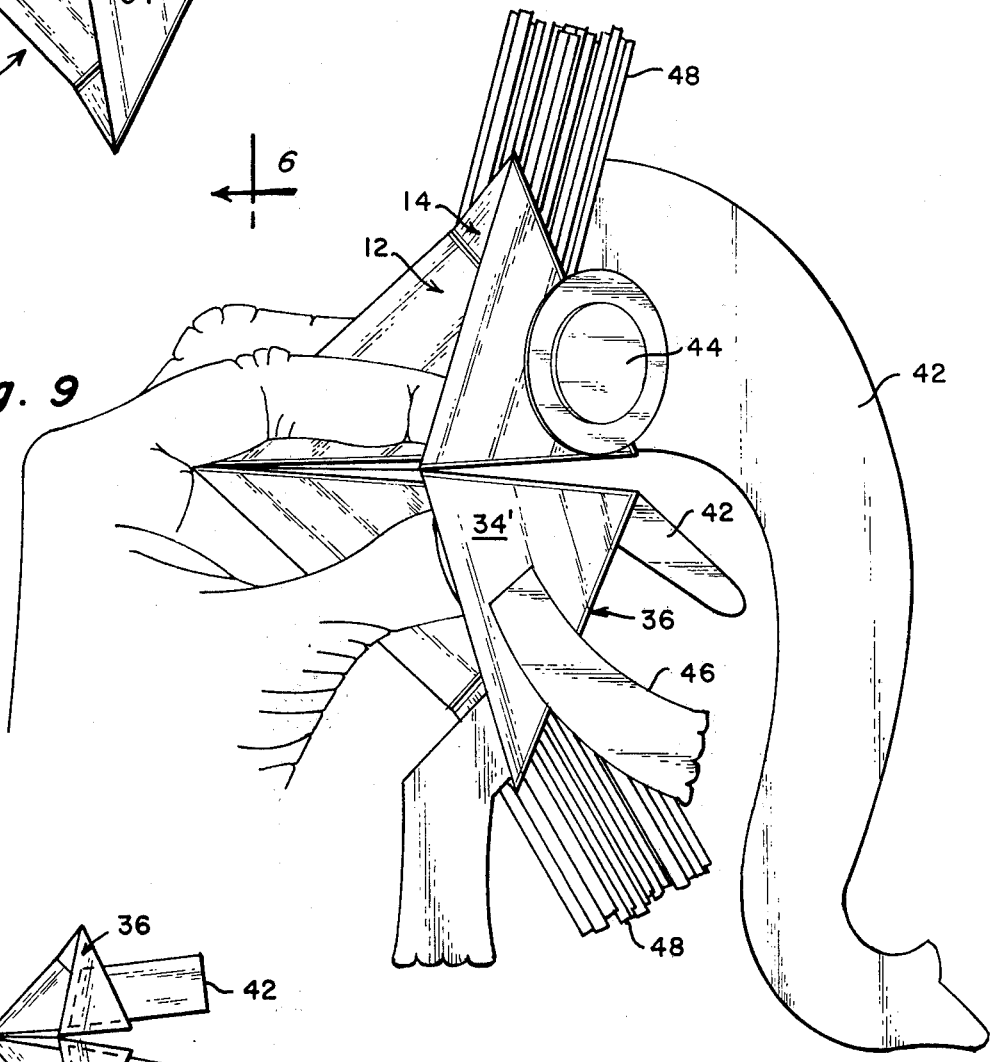
FIG. 9 is a side view of a puppet embodiment of the present invention.

As depicted in FIG. 9, the projections 42 project beyond the elements 36 and are shaped to provide the structure with the appearance of an animal. The shape given the projections 42 and may additional members (as for example eyes 44, legs 46 and fringe 48) can be changed to impart to the puppet structure the appearance of numerous different birds, reptiles or animals. These additional members are, for the purpose of this disclosure, termed character defining means. Such character defining means many include representations of hair, beaks, eyes, noses, arms, legs, or any distinguishing feature that would render to the structure of this invention the appearance of an animate character.

A preferred embodiment of the invention, as depicted in FIG. 9, comprises a folded base sheet 12 and outer sheets 14 of FIGs. 5, 6 and 7 as previously disclosed including a plurality of planar character defining projections 42 affixed to a pair of opposite base minor triangles 30. The projections 42 of FIG. 9 are the trunk and tusks of an elephant extending outwardly from the base structure 10 and comprise a plurality of character defining projections. As depicted in FIG. 9, eye simulating character defining means 44 are affixed to two outer sheet triangles 34' adjacent the upper character defining projection 42. Legs 46 are affixed to the outer sheet triangles 34'.

A further preferred embodiment as depicted in FIG. 9 would include a plurality of elongated strips shown as the fringe 48 affixed adjacent the character defining projections 42. The appearance of these character defining means are selected to provide a distinctive appearance to the character of the structure and the arrangement shown in FIG. 9 is merely illustrative.

A preferred embodiment of the structure 10, having special utility as a principal component of a mask, is depicted in FIG. 10 where a first element 50 consisting of a four-sided element 36 having outer sheet triangles 35 has both base minor triangles 26 on the first element 50 affixed to adjacent base minor triangles.

Figure 11:
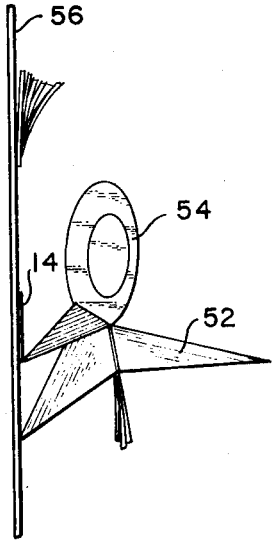
FIG. 11 is a side view of a mask embodiment of the invention.
Figure 12:
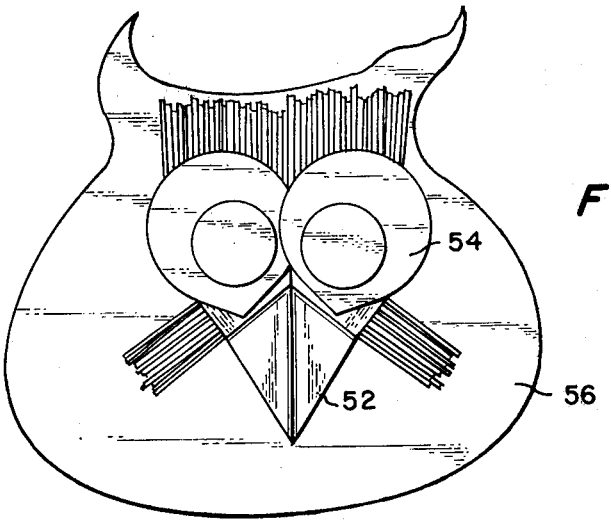
FIG. 12 is a frontal view of the embodiment of FIG. 10.

An illustrative preferred embodiment is depicted in FIGS. 11 and 12 with a first character defining means 52 connected to the outer sheet triangles 35 of FIG. 10. In the embodiment of FIGS. 11 and 12, the first character defining member 52 is an extension of the outer sheets 35. Alternatively, outer sheets 35 could be affixed at their interior contacting surface to provide an essentially flat, planar projection (not shown). In addition, the outer sheets 35 could be folded inwardly and affixed in that position (not shown). In the latter instance, a projection differing in shape or size from outer sheets 35 could be affixed to the interior portion of outer sheets 35 and protrude therefrom.

In the embodiment shown, two outer sheet triangles 34 are affixed to a character defining portion 54 of a mask. As here embodied, the character defining portion 54 depicts the eyes of an owl. A base support 56 for the mask is attached to one of the outer sheets 14 of an element 36. The attached outer sheet 14 is opposite the element having outer sheet triangles 35. As here embodied, the base support 56 is a planar element depicting the outline of the head of the owl. Alternatively, the base support could be a paper bag (not shown).

The placement of the folded structure 10 between the elements of the mask provides a spacial separation of those elements that enhance the three-dimensional aspects of the mask. In addition, the structure allows the components of the mask to collapse to a relatively flat structure while maintaining the appearance of the character depicted.

Referring now to FIG. 13, a blank for forming one embodiment is illustrated comprised of a primary sheet generally 60 with four primary sheet corners 62, and four primary sheet edges 64 of equal length. The primary sheet edges 64 have midpoints 66. The blank has two main midpoint fold lines 68 passing through the center 16 of the primary sheet 60 bisecting the sheet at the primary sheet midpoints 66. Two main diagonal fold lines 70 extend through the center 16 and the four corners 62. Main diagonal fold lines 70 comprise the concave outer sheet folds 32 and the concave base folds 28 of FIG. 5. Four secondary fold lines 74 extend through the intersection 76 of the secondary diagonal fold lines 72 and the main diagonal fold lines 70.

Figure 1:
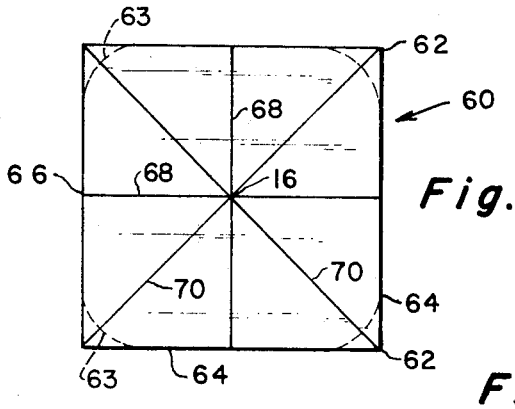
FIG. 1 is a frontal view of the principal component of one embodiment of the present invention.

While the corners 62 are depicted as being square, the blank 60 may have round corners depicted in FIGS. 1 and 4 by dashed lines 63 thereby providing the outer sheets of the final structure with rounded outer sheets.

Figure 2:
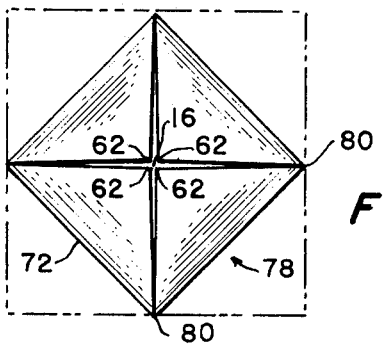
FIG. 2 is a frontal view of the embodiment of FIG. 1 showing the formation of a preliminary structure.
Figure 3:
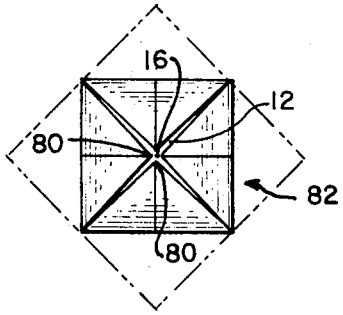
FIG. 3 is a frontal view showing the formation of a square base sheet.

Preferably, the fold lines are produced in a manner depicted in FIGS. 1 through 4. Referring now to FIGS. 1 through 4 where a method of making one embodiment of the invention is illustrataed, a primary sheet 60 is provided having four equal sides 64, four corners 62 and a center 16. FIG. 1 depicts the primary sheet with the main diagonal fold lines 70 and the main midpoint fold lines 68 placed therein. The folds depicted in FIG. 1 need not be formed prior to any other folds; however, they do locate the center 16 and they are necessarily introduced in the final steps of forming the structure. FIG. 2 depicts the folding of the corners 62 to the center 16 forming a second square 78 with the corners 80 of second square 78, the midpoints 66 forming main diagonal folds along fold lines 72. FIG. 3 depicts the folding of the corners 80 to the center 16 opposite the surface of the second square 78 to form a third square 82. In an embodiment of the invention where the main diagonal folds 70 and the main midpoint folds 68 are not previously placed, these folds could be formed after shaping of the third square 82. FIG. 4 depicts the opposite side of the embodiment of FIG. 3 except that the size of the structure is larger to more clearly illustrate the configuration of outer sheets 14.

Preferably, two pairs of base triangles 30 are then affixed and character defining means attached to the structure in a manner previously described to give the structure the appearance of an animal.

Where the previously disclosed method is to form a puppet structure it is preferred that two opposite pairs of base triangles (38 or 40 in FIG. 6), one from each of four four-sided elements 36, are affixed with character defining projections. Such projections are affixed between the two pairs of base minor triangles 38 or 40.

Where the previously disclosed method is to form a mask structure utilizing the base element of FIG. 10, the two opposite pairs 38 of base triangles are affixed to a single four-sided element 36. Character defining means are then attached to the outer sheets 35 adjacent the single element. Character defining means are also affixed to the entire outer sheet 14 of the element 36 opposite the single element 35 to form a three-dimensional mask.

The invention provides a structure that is simple to make, that provides a support structure that is strong and flexible that allows structures incorporating the invention to be easily assembled and stored.

It will be apparent to those skilled in the art that various modifications and variations could be made to the embodiments of the invention disclosed herein without departing from the scope of the invention as defined by the appended claims.

What is claimed is:

1. A folded structure comprising:

a. a substantially square base sheet having a center, four base edges and four base corners with eight base folds therein, four of said base folds being convex base folds passing from the midpoint of each of said base edges forming four minor squares, said minor squares being bounded by said convex base folds and said base edges; four of said base folds being concave base folds bisecting said minor squares form said center to said base corners to form eight base minor triangles; and b. four outer sheets connected to each of said minor squares along said base edges, said outer sheets each having a concave outer sheet fold extending from said base corners bisecting said outer sheets forming eight outer sheet triangles, said outer sheets and said minor square sheets forming four four-sided elements each comprised of two base minor triangles and two outer sheet triangles.

2. The structure of claim 1, where each of said outer sheets are square and each is equal in area to one of said minor squares.

3. The structure of claim 2, where said base sheet and said outer sheets are integrally formed from a primary square sheet of uniform thickness.

4. The structure of claim 1, where said base sheet is comprised of a material having a greater thickness than said four outer sheets.

5. The structure of claim 1, where two pairs of adjacent base minor triangles of at least one of said elements are joined together.

6. The structure of claim 5, where only one base minor triangle per element is joined to an adjacent base minor triangle.

7. The structure of claim 6 further including a first planar projection, said first planar projection being affixed between at least one pair of joined base minor triangles.

8. The structure of claim 7 further including a second planar projection, said second planar projection being affixed between one pair of joined base minor triangles opposite said first planar projection with said projections comprising character defining means.

9. The structure of claim 8 where said planar projection projects beyond the elements to impart to said structure the appearance of a character.

10. The structure of claim 5 where a first element has both base minor triangles affixed to adjacent base minor triangles.

11. The structure of claim 10 further including a character defining member, said member being connected to the outer sheet triangles of said first element.

12. The structure of claim 11 where the outer sheet triangles adjacent said outer sheet triangles of said first element are affixed to a first character defining planar portion of a mask.

13. The structure of claim 12 where the entire outer sheet of a second element opposite said first element is affixed to a second character defining means comprising a base support member of said mask.

14. A mask comprising:

a. a folded structure having a substantially square base sheet, a center, four base edges and four base corners, said base having eight folds therein, four of said base folds being convex base folds passing from the midpoint of each of said base edges forming four minor squares, said minor square being bounded by said convex base folds and said base edges, four of said base folds being concave base folds bisecting said minor squares from said center to said base center to form eight base minor triangles, with four consecutive base minor triangles affixed to one another forming one immobilized minor square;

b. four outer sheets connected to each of said minor squares along said base edges, said outer sheets each having a concave outer sheet fold passing from said base corners bisecting said outer sheets forming eight outer sheet triangles, said outer sheets and said minor square sheets forming four four-sided elements each comprised of two inner base minor triangles and two outer sheet triangles, with the outer sheet corresponding to said immobilized minor square forming a support structure;

c. a first character defining element affixed to the two outer sheet triangles adjacent the outer sheet triangles of said support structure; and d. a second character defining element affixed to the entire outer sheet of the element opposite said support structure, said second character defining element comprising a base element.

15. The mask of claim 14 where said first character defining means comprises an eye simulating structure.

16. A blank for making a folded structure comprising; a square planar primary base sheet having four corners, four edges of equal length, said edges having midpoints, two main midpoint fold lines passing through the center of said sheet bisecting each of said edges at said midpoints, two main diagonal fold lines passing through said center and said four corners, four secondary diagonal fold lines connecting said midpoints and four secondary fold lines passing through the four intersections of said secondary diagonal fold lines and said main diagonal fold lines.

17. The blank of claim 16 wherein said corners are rounded.

18. A method of making a folded novelty structure from a primary square sheet having a center and four corners comprising the steps of:

a. folding the corners of said sheet, all on the same side so as all four corners are placed at the center forming a second square;

b. folding the corners of said second square to the center of said squares at the opposite side of said second square forming a third square comprised of a base sheet and four square outer sheets;

c. folding said third square along the edges of said four square outer sheets forming four minor squares;

d. folding each minor square of said base sheet with a concave fold from the center of said base sheet to the corners of said inner sheet forming triangular portions on said base sheet;

e. folding said four square outer sheets in a concave fold facing said minor squares from the corner of said base sheet bisecting said four square outer sheets to form four four-sided elements and comprised of two base triangular portions and two outer sheet triangular portions;

f. affixing two pairs of base triangular portions; and g. affixing planar character defining surfaces and projections to portions of said structure.

19. The method of claim 18 where said two pairs of base triangular portions are each comprised of a single base triangular portion from each of said four four-sided elements and said character defining projectinos are affixed between said two pairs of base triangular portions.

20. The method of claim 18 where said two pairs of base triangular portions are comprised of two base triangular portions on a single element and the base triangular portions adjacent thereto and said character defining surfaces are affixed to an element opposite said single element and additional character defining surfaces are affixed to outer sheet triangular portions adjacent said single element.

* * * * *

UNITED STATES PATENT OFFICE

CERTIFICATE OF CORRECTION

Patent No. 3,992,724 Dated November 23, 1976

Inventor(s) Robert W. Bosler

It is certified that error appears in the above-identified patent and that said Letters Patent are hereby corrected as shown below:

Claim 1, column 7, line 4, change "form" to --from--.

Claim 19, column 8, line 58, change "projectinos" to --projections--.

Signed and Sealed this

Eighth Day of February 1977

[SEAL]

*Attest:*

RUTH C. MASON
*Attesting Officer*

C. MARSHALL DANN
*Commissioner of Patents and Trademarks*